United States Patent [19]

Kourtz et al.

[11] 4,421,707

[45] Dec. 20, 1983

[54] ACRYLIC WET SPINNING PROCESS

[75] Inventors: Raymond E. Kourtz; Shashikumar H. Daftary, both of Pensacola, Fla.

[73] Assignee: American Cyanamid Company, Stamford, Conn.

[21] Appl. No.: 373,090

[22] Filed: Apr. 29, 1982

[51] Int. Cl.[3] ..... D01F 6/18

[52] U.S. Cl. ..... 264/182; 264/210.8

[58] Field of Search ..... 264/182, 235, 206, 346, 264/210.8; 526/342

[56] References Cited

U.S. PATENT DOCUMENTS

| | | | |
|---|---|---|---|
| 3,813,372 | 5/1974 | Joh et al. | 526/342 |
| 3,915,942 | 10/1975 | Tamura | 526/342 |
| 4,017,561 | 4/1977 | Miessen et al. | 264/182 |
| 4,219,523 | 8/1980 | Porosoff | 264/206 |

*Primary Examiner*—Jay H. Woo

*Attorney, Agent, or Firm*—Frank M. Van Riet

[57] ABSTRACT

By adjusting the viscosity of the spinning solution, low molecular weight polymers of acrylonitrile can be spun to provide useful fiber having an unexpected higher dye color yield than fiber prepared from the corresponding polymer of higher molecular weight.

5 Claims, No Drawings

ACRYLIC WET SPINNING PROCESS

CROSS-REFERENCE TO RELATED APPLICATION

This application is related to application Ser. No. 281,613 filed July 9, 1981 now abandoned. The present application relates to a process for preparing an acrylonitrile polymer fiber of low molecular weight and the related application relates to the low molecular weight fiber.

This invention relates to a process for wet-spinning acrylonitrile polymer fiber from low molecular weight polymers. More particularly, this invention relates to such a process wherein fiber of desirable textile properties and increased dye intensity is obtained.

Acrylonitrile polymer fiber is commercially produced at present by either dry-spinning or wet-spinning procedures. In both of these processes the acrylonitrile fiber-forming polymer is dissolved in a suitable polymer solvent and extruded through a spinneret into a coagulant which precipitates the polymer in fiber form. In dry-spinning the coagulant is a heated gaseous medium which evaporates the solvent to solidify the fiber. In wet-spinning the coagulant is a liquid medium which dilutes and washes out the polymer solvent to solidify the fiber. Additional processing is then conducted to provide the desired fiber.

In the publication *Formation of Synthetic Fibers* by Z. K. Walczak, Gordon & Breach, New York, N.Y., (1977) on page 271, there is provided a table in which the effective values of molecular weight for spinning fiber from various polymers are given. This table is reprinted from Die Physik der Hochpolymeren, by Prof. H. Mark, edited by H. A. Stuart, Springer Verlag, Berlin, Germany (1956) Vol. 4, page 629. In this table, it specifies that the lower limiting number average molecular weight value for fiber-forming acrylonitrile polymers is 15,000 and that below this value no fiber of any value is obtained. In order to ensure that adequate physical properties are obtained, commercial procedures including dry-spinning and wet-spinning employ acrylonitrile fiber-forming polymers having number average molecular weight values of at least about 16,000 and generally at least 18,000 or more. The upper limiting number average molecular weight value is said to be 45,000 and that above this value no advantages in fiber properties are obtained but larger demands are put on mechanical work to overcome high viscosity of the spinning compositions.

In a typical commercial wet-spinning process, for example, a fiber-forming acrylonitrile polymer of number average molecular weight in excess of 16,000 is dissolved in concentrated thiocyanate salt solution to provide a spinning composition which has a polymer concentration of about 10 weight percent. If the polymer concentration exceeds 10 weight percent, the resulting polymer solution becomes too viscous to process continuously and frequent stoppages in production are encountered. Thus, at a number average molecular weight of the fiber-forming acrylonitrile polymer of 16,000 or greater, it is necessary to limit the polymer concentration in the spinning composition to about 10 weight percent in order to obtain viscosities of the spinning composition that enable continuity in processing to be achieved.

This restriction as to polymer concentration in the spinning composition limits the production from a single spinneret assembly in a given time period of operation, requires the use of large quantities of polymer solvent, and requires recovery of large quantities of polymer solvent and liquid coagulant. Although the process provides acrylonitrile polymer fiber of admirable textile properties with excellent dyeability, the limitation as to number average molecular weight of the acrylonitrile polymer and the attendant difficulties as to limited polymer concentration in thespinning composition and the related problems leave much to be desired.

What is needed, therefore, is a process for dry-spinning or wet-spinning fiber-forming acrylonitrile polymer fiber which enables use to be made of low number average molecular weight acrylonitrile polymers so as to overcome the problems encountered with the use of high number average molecular weight acrylonitrile polymers. The provision for such a process would satisfy a long-felt need and constitute a significant advance in the art.

In accordance with the present invention, there is provided a process for preparing an acrylonitrile polymer fiber which comprises preparing a spinning composition of a fiber-forming acrylonitrile polymer in an aqueous thiocyanate salt solution said polymer having a composition of about 80 to about 95 weight percent acrylonitrile, from about 5 to about 12 weight percent of methyl methacrylate and any balance of a comonomer free of acid dyesites and said polymer having a number average molecular weight in the range of about 9,000 to about 14,750, said spinning composition having a polymer concentration in the range of about 12.5 to 16.0 weight percent in an aqueous thiocyanate salt solution in which the thiocyanate salt content is in the range of about 38 to 45 weight percent based on the total weight of solution and said spinning solution having a viscosity in the range of 28–60 poise determined by the falling ball method at 40° C. extruding said spinning solution into a dilute aqueous thiocyanate salt solution to form a wet-gel fiber, washing and stretching the wet-gel fiber to remove thiocyanate salt and provide polymer orientation and thereafter collapsing the wet-gel structure.

Surprisingly, when acrylonitrile polymer fiber is prepared in accordance with the process of the present invention, the resulting fiber has physical properties equally as good as fiber prepared from high molecular weight acarylonitrile polymers and has a higher dye color yield than fiber prepared from the corresponding polymer of higher molecular weight.

In carrying out the process of the present invention, an acrylonitrile polymer having specific composition and a number average molecular weight in the range of 9,000 to 14,750 is employed. The polymer composition will comprise from about 80 to about 95 weight percent acrylonitrile, preferably 85 to 95 weight percent acrylonitrile, from about 5 to about 12 weight percent methyl methacrylate, preferably about 9 to 11 weight percent methyl methacrylate and any balance of one or more comonomers free of acid dyesites.

A particularly preferred method for preparing the useful polymers is by aqueous emulsion or dispersion polymerization procedures employing a redox catalyst system comprising an oxidizing agent and reducing agent. Typically, the oxidizing agent will be a persulfate, chlorate, perchlorate, peroxide and the like. the reducing agent will be a mixture of a bisulfite and a water-soluble mercaptan such as mercaptoethanol in amounts which control the sulfonic end group content of the polymer and control the molecular weight to within the specified range.

After the polymer is prepared as described it is dissolved in concentrated aqueous thiocyanate salt solution, typically sodium thiocyanate, to prepare a spinning composition containing from about 12.5 to about 16 weight percent of polymer, about 38 to 45 weight percent thiocyanate salt, and the balance water. The resulting spinning composition should have a viscosity when measured by the falling ball method of from about 28 to about 60 poises. The actual concentrations of polymer and thiocyanate salt in the spinning composition as well as the viscosity of the spinning composition will vary depending upon the specific number average molecular weight in the range specified of the particular acrylonitrile polymer selected for use but should be within the ranges specified for viscosity and concentration.

After the spinning composition has been prepared as indicated, it is extruded through a spinneret into a dilute aqueous thiocyanate salt solution in accordance with conventional procedures for wet-spinning acrylonitrile polymer using the specified type of polymer solvent and coagulant. No new teachings are required in this respect and additional processing will also follow conventional procedures without change. Typically, the coagulant will be an aqueous solution of sodium thiocyanate of 10–15 weight percent salt content at a temperature of about −5° to 5° C. The wet-gel filaments provided upon coagulation are subjected to stretching while in the coagulant and subsequently in hot water to provide a total stretch ratio of up to about 19. After hot stretching and washing, the wet-gel filaments are dried to collapse the gel structure and subjected to relaxation in accordance with conventional procedures.

The invention is more fully illustrated in the examples which follow wherein all parts and percentages are by weight unless otherwise specified.

In the examples which follow, reference is made to dye intensity values. These values are determined by dyeing samples of fiber obtained by the process of the present invention with a particular amount of a dyestuff under conditions which lead to complete dyebath exhaustion. For comparison, fiber prepared by the conventional procedure using a polymer of the same monomer content is dyed with the same amount of the same dyestuff under conditions which lead to complete dyebath exhaustion. The dyed sample of conventional fiber is arbitrarily assigned a dye intensity value of 100. Color readings of the fiber of the present invention are obtained using the dyed conventional fiber as the comparison standard.

EXAMPLE 1

A. Polymer Preparation

To a well agitated 6 liter cylinderical vessel were added the following ingredients at the rates indicated below.

| Ingredients | Addition Rate (Grams 1 Hour) |
|---|---|
| Mixed Monomer (90.8% acrylonitrile) (9.2% methyl methacrylate) | 2,722.2 |
| Sodium chlorate ($NaClO_3$) | 19.1 |
| Sodium bisulfite ($NaHSO_3$) | 56.6 |

-continued

| Ingredients | Addition Rate (Grams 1 Hour) |
|---|---|
| Sodium nitrate ($NaNO_3$) | 9.5 |
| 2-mercaptoethanol | 17.4 |
| Copper sulfate ($CuSO_4.5H_2O$) | 0.082 |
| Water | 4,952.9 |

Polymerization conditions and polymer proporties were as listed below.

Polymerization Conditions

| Monomer Feed Composition % | |
|---|---|
| Acrylonitrile | 98.8 |
| Methyl methacrylate | 9.2 |
| Monomer Feed Concentration % | 35.0 |
| Oxidant/Monomer (g. $NaClO_3$/100 g. monomer) | 0.7 |
| Reducer/Monomer (g. $NaHSO_3$/100 g. monomer) | 2.08 |
| g. 2-mercaptoethanol/100 g. monomer) | 0.64 |
| g. $CuSO_4.5H_2O$/100 g. monomer | 0.003 |
| g. $NaNO_3$/100 g. monomer | 0.35 |
| Residence time, minutes | 54 |
| Temperature °C. | 55 |

Reactor Overflow (Steady State)

| | |
|---|---|
| Number average molecular weight | 10998 |
| Polymer concentration % | 29.5 |
| Monomer conversion % | 85.8 |
| pH | 2.1 |
| Slurry viscosity | thin |

Polymer Crumb

| | |
|---|---|
| Number average molecular weight | 11800 |
| Methyl methacrylate % | 10.4 |
| Acrylonitrile | 89.6 |
| Dewatered Solids (Centrifuged) % | 56 |

Dope Preparation

The dewatered polymer crumb was dissolved in 57% aqueous NaSCN to obtain a dope composition containing 13.8% polymer and 41.9% NaSCN and having a viscosity of 30.5 poises at 40° C.

The dope was spun on a laboratory spinning machine under the conditions listed below.

| | |
|---|---|
| Spinneret hole size/number of holes | 90μ/80 |
| Total stretch ratio | 13.88 |
| Solvent stretch | 2.73 |
| Hot stretch | 5.09 |
| Coagulant NaSCN concentration % | 14.2 |
| Coagulant temperature °C. | −3.3 |
| Hot stretch temperature °C. | 98–100 |
| Denier Speed Product (DSP) | 192 |
| Extrusion temperature °C. | 62 |
| Maximum pullaway, meters/minute at 192 DSP | 14.0 |
| Spinning continuity | Good |
| Conditioned fiber relaxation, % (70° C. wet bulb, 120° C. Dry bulb) | 12.1 |
| Total fiber relaxation, % (Conditioned and steamed) | 36.6 |
| Denier filament (Conditioned and steamed) | 3.0 |

Fiber Physical Properties

| | Fiber of Ex. 1 | Commercial Range |
|---|---|---|
| Straight tenacity (grams/denier) | 2.6 | 2.2–3.6 |
| Straight elongation (%) | 32 | — |
| Loop tenacity (grams/denier) | 1.6 | 1.6 minimum |
| Loop elongation (%) | 18 | 18–28 |
| Dye intensity | 110 | 100 |

EXAMPLES 2–4

Following the procedure of Example 1, a series of polymers were prepared having varying number average molecular weight values. Variations in catalyst feed rates provided the changes in molecular weight. These polymers were spun into fiber following the procedure given in Example 1. For comparison purposes a commercial polymer of similar composition was also spun in the same manner. In the tabulations which follow are given the polymer identification as well as the fiber properties.

| | Comparison | Example 2 | Example 3 | Example 4 |
|---|---|---|---|---|
| Polymer Identification | | | | |
| Number average MW | 20,300 | 9,200 | 10,700 | 12,700 |
| Methyl methacrylate % | 10.7 | 10.7 | 10.7 | 10.6 |
| Acrylonitrile % | 89.3 | 89.3 | 89.3 | 89.4 |
| Dope Properties | | | | |
| Polymer % | 11.2 | 15.8 | 14.9 | 14.2 |
| NaSCN % | 40.8 | 41.9 | 41.2 | 42.5 |
| Dope Viscosity (poise 40° C.) | 50.0 | 42.0 | 43.5 | 57.0 |
| Maximum pullaway meters/min. at 192 DSP | 12.1 | 12.0 | 9.6 | 8.2 |
| Maximum total stretch ratio | 18 | 20 | 20 | 18 |
| Spinning continuity | Good | Good | Good | Good |
| Conditioned Fiber relation % | 12.5 | 12.7 | 13.5 | 13.2 |
| Total fiber relaxation (Conditioned & Steamed) | 35.2 | 36.8 | 36.8 | 36.0 |
| Fiber Physical Properties | | | | |
| Denier/filament | 3.1 | 3.6 | 3.9 | 3.2 |
| Straight tenacity (g/d) | 3.6 | 2.9 | 2.4 | 2.9 |
| Straight elongation % | 36 | 39 | 32 | 33 |
| Loop tenacity (g/d) | 2.6 | 2.2 | 1.8 | 2.3 |
| Loop elongation % | 24 | 19 | 21 | 21 |
| Dye intensity | 100 | 110 | 110 | 110 |

EXAMPLE 5

Following the general procedure of Example 1, another polymer was prepared having a composition of 10.7% methyl methacrylate and 89.3% acrylonitrile with a number average molecular weight of 13,900. The spinning composition had a composition of 13% polymer and 40% NaSCN. The spinning composition was spun into a variety of fiber deniers and in the tabulation which follows are shown the fiber properties as well as those of the commercial comparison fiber.

| Fiber Properties Fiber Type | Fiber of Example 5 | Comparison Fiber |
|---|---|---|
| 4.8 denier bright tow | | |
| Straight tenacity (g/d) | 2.50 | 2.50 |
| Straight elongation (%) | 53 | 49 |

-continued

| Fiber Properties Fiber Type | Fiber of Example 5 | Comparison Fiber |
|---|---|---|
| Loop tenacity (g/d) | 1.80 | 2.20 |
| Loop elongation (%) | 33 | 36 |
| 2.5 denier bright tow | | |
| Straight tenacity (g/d) | 3.0 | 2.49 |
| Straight elongation (%) | 31 | — |
| Loop tenacity (g/d) | 1.6 | — |
| Loop elongation (%) | 13 | — |
| 1.5 denier bright tow | | |
| Straight tenacity (g/d) | 2.6 | 3.3 |
| Straight elongation (%) | 40 | 40 |
| Loop tenacity (g/d) | 2.3 | 2.4 |
| Loop elongation (%) | 31 | 30 |
| 6.0 denier semi-dull, high shrinkage | | |
| Straight tenacity (g/d) | 2.3 | 3.1 |
| Straight elongation (%) | 21 | 28 |
| Loop tenacity (g/d) | 1.2 | 0.8 |
| Loop elongation (%) | 5 | 4 |
| Above boiled off 8.0 denier | | |
| Straight tenacity (g/d) | 1.8 | 2.2 |
| Straight elongation (%) | 33 | 67 |
| Loop tenacity (g/d) | 1.6 | 1.9 |
| Loop elongation (%) | 30 | 49 |

COMPARATIVE EXAMPLE

The polymer of Example 2 was prepared as a spinning composition containing 11.2% polymer and 41% sodium thiocyanate. The composition had a viscosity of 10 poises. The spinning composition was spun into fiber following the procedure of Example 1 to provide a fiber of 3.1 d tex/filament. Physical properties of the fiber were poor, straight tenacity being less than 1.5 grams per denier and loop tenacity being less than 1.0 gram per denier.

What is claimed:

1. A process for preparing an acrylonitrile polymer fiber which comprises preparing a spinning composition of a fiber-forming acrylonitrile polymer in an aqueous thiocyanate salt solution, said polymer having a composition of about 80 to about 95 weight percent acrylonitrile, from about 5 to about 12 weight percent of methyl methacrylate and any balance of a comonomer free of acid dyesites and said polymer having a number average molecular weight in the range of about 9,000 to about 14,750, said spinning composition having a polymer concentration in the range of about 12.5 to 16.0 weight percent in an aqueous thiocyanate salt solution in which the thiocyanate salt content is in the range of about 38 to 45 weight percent based on the total weight of water and polymer and said spinning solution having a viscosity in the range of 28–60 poise determined by the falling ball method at 40° C., extruding said spinning solution into a dilute aqueous thiocyanate salt solution to form a wet-gel fiber, washing and stretching the wet-gel fiber to remove thiocyanate salt and provide polymer orientation and thereafter collapsing the wet-gel structure.

2. The process of claim 1 wherein the acrylonitrile polymer has a composition of 89–90 weight percent acrylonitrile and 11–10 weight percent methyl methacrylate.

3. The process of claim 1 wherein the dilute aqueous thiocyanate salt solution contains 10–15 weight percent thiocyanate salt.

4. The process of claim 3 wherein the dilute aqueous thiocyanate salt solution is at a temperature in the range of 5° to 50° C.

5. The process of claim 1 wherein the thiocyanate salt is sodium thiocyanate.

* * * * *